United States Patent [19]

Strande

[11] 4,204,098

[45] May 20, 1980

[54] MULTIPLE CIRCUIT SWITCH ASSEMBLY

[75] Inventor: Edward J. Strande, Beaverton, Oreg.

[73] Assignee: Tektronix, Inc., Beaverton, Oreg.

[21] Appl. No.: 772,185

[22] Filed: Feb. 25, 1977

Related U.S. Application Data

[63] Continuation-in-part of Ser. No. 667,736, Mar. 17, 1976, abandoned.

[51] Int. Cl.[2] ..... H01H 9/00

[52] U.S. Cl. ..... 200/1 R; 200/6 R; 200/16 A; 200/153 L; 200/275

[58] Field of Search ..... 200/1 R, 6 R, 6 B, 6 BA, 200/6 BB, 6 C, 153 L, 153 LA, 153 LB, 238, 264, 243–247, 280, 281, 293, 294, 295, 302, 303, 330, 296, 275, 292, 159 B, 5 R, 5 A, 159 A, 16 A; 174/35 TS; 339/176 MP; 361/398, 404, 416

[56] References Cited

U.S. PATENT DOCUMENTS

| | | | |
|---|---|---|---|
| 2,229,585 | 1/1941 | Osenberg | 174/35 TS X |
| 3,165,732 | 1/1965 | Klosterman | 200/153 X |
| 3,383,487 | 5/1968 | Wicher | 200/292 X |
| 3,409,747 | 11/1968 | Mincone | 200/11 D |
| 3,562,464 | 2/1971 | Vollum et al. | 200/6 BA X |
| 3,696,411 | 10/1972 | Kilby et al. | 340/365 A |
| 3,719,788 | 3/1973 | Holland et al. | 200/6 BB X |
| 3,723,674 | 3/1973 | Khitro et al. | 200/11 TW |
| 3,745,288 | 7/1973 | Reimer | 361/398 X |
| 3,800,105 | 3/1974 | Thornley | 200/264 X |
| 3,860,771 | 1/1975 | Lynn et al. | 200/5 A |
| 3,862,381 | 1/1975 | Glaister et al. | 200/5 A |
| 3,900,711 | 8/1975 | Holland | 200/238 |
| 3,932,722 | 1/1976 | Obata et al. | 200/5 A X |
| 3,978,297 | 8/1976 | Lynn et al. | 200/5 A |
| 4,029,914 | 6/1977 | Schmidt et al. | 200/292 X |
| 4,046,980 | 9/1977 | Rosebrock | 200/153 LA |

FOREIGN PATENT DOCUMENTS

| | | |
|---|---|---|
| 2347722 | 3/1974 | Fed. Rep. of Germany . |
| 2171972 | 9/1973 | France . |
| 1178607 | 1/1970 | United Kingdom . |
| 1201241 | 8/1970 | United Kingdom . |

OTHER PUBLICATIONS

IBM Tech. Disc. Bull.; K. A. Brooks et al.; "Scanning Switch;" Feb. 1968; vol. 10, No. 9, p. 1421.

IBM Tech. Disc. Bull.; D. O. Johnson, Jr.; "Keyboard with Changeable Encoding and Key Designations;" Dec. 1970; vol. 13; No. 7; pp. 2041, 2042.

*Primary Examiner*—James R. Scott

*Attorney, Agent, or Firm*—John D. Winkelman

[57] ABSTRACT

A switch apparatus is provided which closely approximates transmission medium parameters for reducing impedance discontinuities by utilizing a high frequency contact arrangement permitting high bandwidth operation. The apparatus is adaptable for use with both high and low impedance circuitry.

4 Claims, 18 Drawing Figures

MULTIPLE CIRCUIT SWITCH ASSEMBLY

CROSS-REFERENCE TO A RELATED APPLICATION

This application is a continuation-in-part of application Ser. No. 667,736 filed Mar. 17, 1976, now abandoned.

BACKGROUND OF INVENTION

One of the problems associated with switch devices is that of maintaining low impedance discontinuities when, say, the switch is used in environments where inductance and stray capacitance is such that good high frequency response is unobtainable. Examples of such prior art which were concerned with maintaining low impedance discontinuities are the the switch apparatuses described in U.S. Pat. No. 3,719,788 to Holland et al and U.S. Pat. No. 3,900,711 to Holland, both of which are assigned to the assignee of the present invention. The latter mentioned patent to Holland describes a switch contact assembly consisting of a contact member having a resilient mounting member and a U-shaped resilient contact member held together at their free ends by insulation. The insulation reduced the capacitance between the contact member and the mounting member and the total configuration thereof reduced the inductance of the contact member.

Other environments where inductance and stray capacitance affect high-frequency operation are switched attenuator systems or devices. For example, U.S. Pat. Nos. 3,753,170 and 3,820,044 to Holland, also assigned to the assignee of the present invention, attempted to increase high frequency characteristics and to maintain uniform impedance of transmission lines across which the attenuator stages are switched using a high frequency contact arrangement permitting high bandwidths.

However, impedance discontinuities still exist, even in the prior art high frequency devices described, due to the utilization therein of narrow contact fingers, long electrical path lengths, and having metal extending off the transmission mediums into air and over ground planes.

SUMMARY OF THE INVENTION

An ideal type of high frequency switch apparatus for closely approximating transmission medium parameters to overcome the disadvantages of the prior art would include a contact having minimum metal required to approximate the transmission line characteristics and have the contact located only in the area of the gap on the transmission line and also be as low in the air as possible, i.e., flat on the transmission lines, when closed. Accordingly, the present invention switch apparatus utilizes a small metal contact bonded to a non-conductive elastomeric backing. The switch contact is held open by either molding the elastomeric material into preloaded shapes or constraining it within a girdle in such a way that a flat elastomer becomes preloaded in assembly. The switch apparatus is closed by a force applied to the elastomeric material backing over the contact area. When the force is released, the elastomer's restoring force (memory) lifts the contact off the transmission line.

It is, therefore, an object of the present invention to provide an improved high frequency switch apparatus utilizing minimum metal.

It is a further object of the present invention to provide an improved high frequency switch apparatus of small size and utilizing a minimum of components.

It is still a further object of the present invention to provide an improved switch apparatus having snap-in assembly to reduce assembly costs.

The foregoing and numerous other objects, advantages, and inherent functions of the present invention will become apparent as the same is more fully understood from the following description which describes the preferred embodiment and other embodiments of the present invention; it is to be understood, however, that these embodiments are not intended to be limiting nor exhausting of the invention, but are given for purposes of illustration in order that others skilled in the art may fully understand the invention and principals thereof and the means of applying it in practical use so that they may modify it in various forms, each as best may be suited to the conditions of the particular use.

DESCRIPTION OF DRAWINGS

In the drawings:

FIG. 1, including

FIG. 2, including

FIG. 3, including

FIG. 6, including

FIG. 7, including

FIG. 8, including

FIG. 9, including FIG. 10, including

DESCRIPTION OF THE INVENTION

Figure 1A:
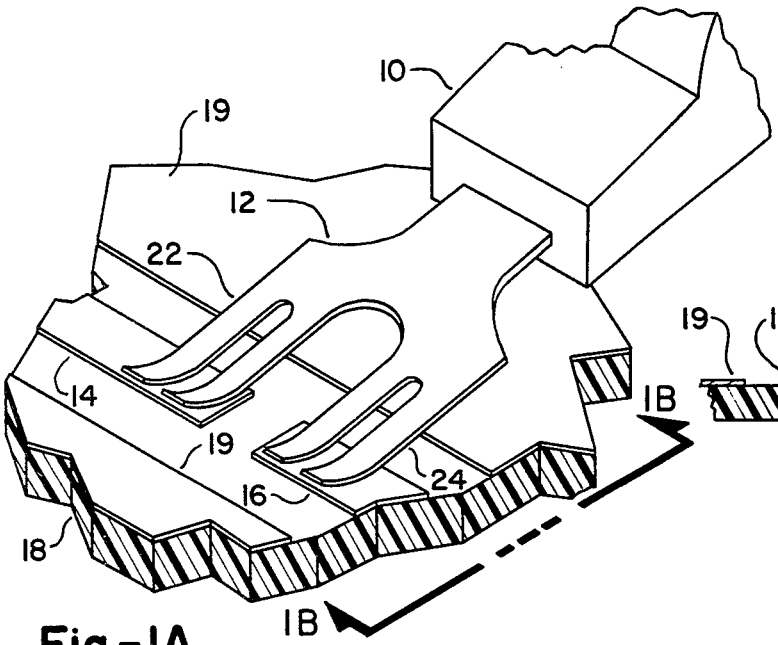
Fig-1A (PRIOR ART)
FIGS. 1A and 1B, is a switch apparatus made in accordance with the prior art.
Figure 1B:
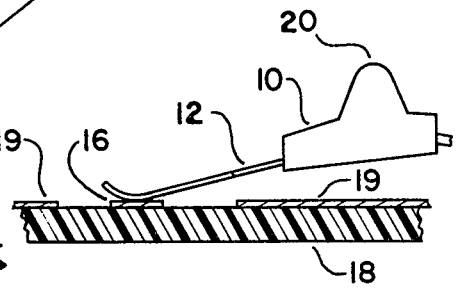
Fig-1B (PRIOR ART)

Referring now to the drawings, a switch apparatus for maintaining low impedance discontinuities in environments where stray capacitance and inductance reduce high frequency response in accordance with the prior art is shown in FIGS. 1A and 1B. The switch comprises an insulator member 10, U-shaped resilient conductive contact member 12, and a pair of fixed contacts 14, 16 formed by conductive strips which, in combination with a metal ground plane 19 placed on a utilization means such as a circuit board 18, form a transmission line well known to those in the art. Contact member 12 is embedded in one end of the mounting member 10, which is preferrably molded out of a suitable plastic material and is provided with a cam follower projection area 20. Although not shown in the drawings, mounting member 10 is springably mounted to the circuit board 18 and is adapted for movement toward the circuit board when, say, biased with a cam (not shown) to close the switch, i.e., contact member 12 engaging the pair of fixed contacts 14, 16 or away from the circuit board to open the switch. The contact member 12 may be provided with a pair of spaced parallel leg portions 22, 24 which engage fixed contacts 14, 16 respectively, and whose other ends are joined in common and embedded into the mounting member 10. This apparatus provides for a somewhat lower stray capacitance and reduces the inductance because the contact member 12 is isolated from its mounting. Additionally, the free ends of the contact member, i.e., spaced parallel leg portions 22, 24 may be split into two halves to provide bifurcated contact as shown for better electrical contact.

Figure 2A:
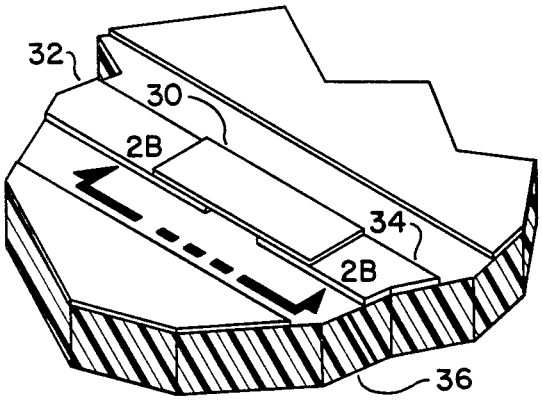
FIGS.2A and 2B, is an ideal switch apparatus to which the present invention is directed.
Figure 2B:
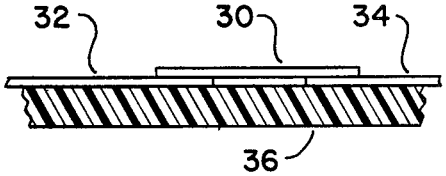

Shown in FIG. 2 is an ideal switch contact for use in a switch apparatus, or attenuator, etc., which would overcome the disadvantages of the prior art and to which the present invention is directed. The ideal contact comprises a contact 30 disposed over a pair of fixed contacts 32, 34 which could be formed, say, by conductive strips on a utilization means such as circuit board 36. Since the contact 30 is disposed directly over the fixed contacts, less metal is required as opposed to the contact member 12 in the prior art. Since less metal is required, the contact closely approximates the transmission line characteristics or perimeters, thereby almost completely reducing impedance discontinuities.

Figure 3A:
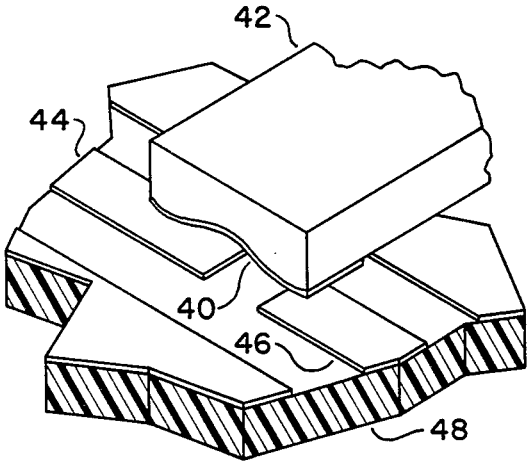
FIGS. 3A and 3B, is a switch apparatus closely approximating the ideal switch apparatus of FIG. 2.
Figure 3B:
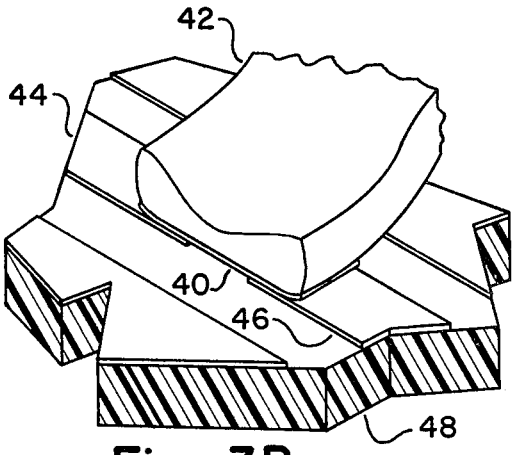

Referring now to FIG. 3, there is shown a switch apparatus having a contact member 40 which is formed and etched in place on an elastomeric material 42, precisely located. The contact member is disposed over a pair of fixed contacts 44, 46 formed by conductive strips on a utilization means such as a circuit board 48. The elastomeric material is secured to, say, the circuit board (the securing of the elastomeric material to the circuit board is not shown) for movement between an open position spaced from the pair of fixed contacts as shown in FIG. 3A or a closed position engaging the pair of fixed contacts to join or connect the transmission line elements as shown in FIG. 3B. An actuation means such as a cam could be used to activate the switch, which would then make it necessary to provide a cam follower means to act on the elastomeric material 42. This contact scheme is completely detailed and described in the previously mentioned co-pending patent application, Ser. No. 631,591 filed Nov. 13, 1975 by William E. Berg and assigned to the assignee of the present invention. As the securing of the contact to the elastomeric material is completely described in this co-pending application, no further discussion thereof will be provided. As can be discerned from the drawings, however, the apparatus of FIG. 3 very closely approximates the ideal apparatus of FIG. 2. Accordingly, the present invention, which is an improvement of the Berg invention, extends the basic principles and provides a preferred embodiment for use in switching environments.

Figure 4:
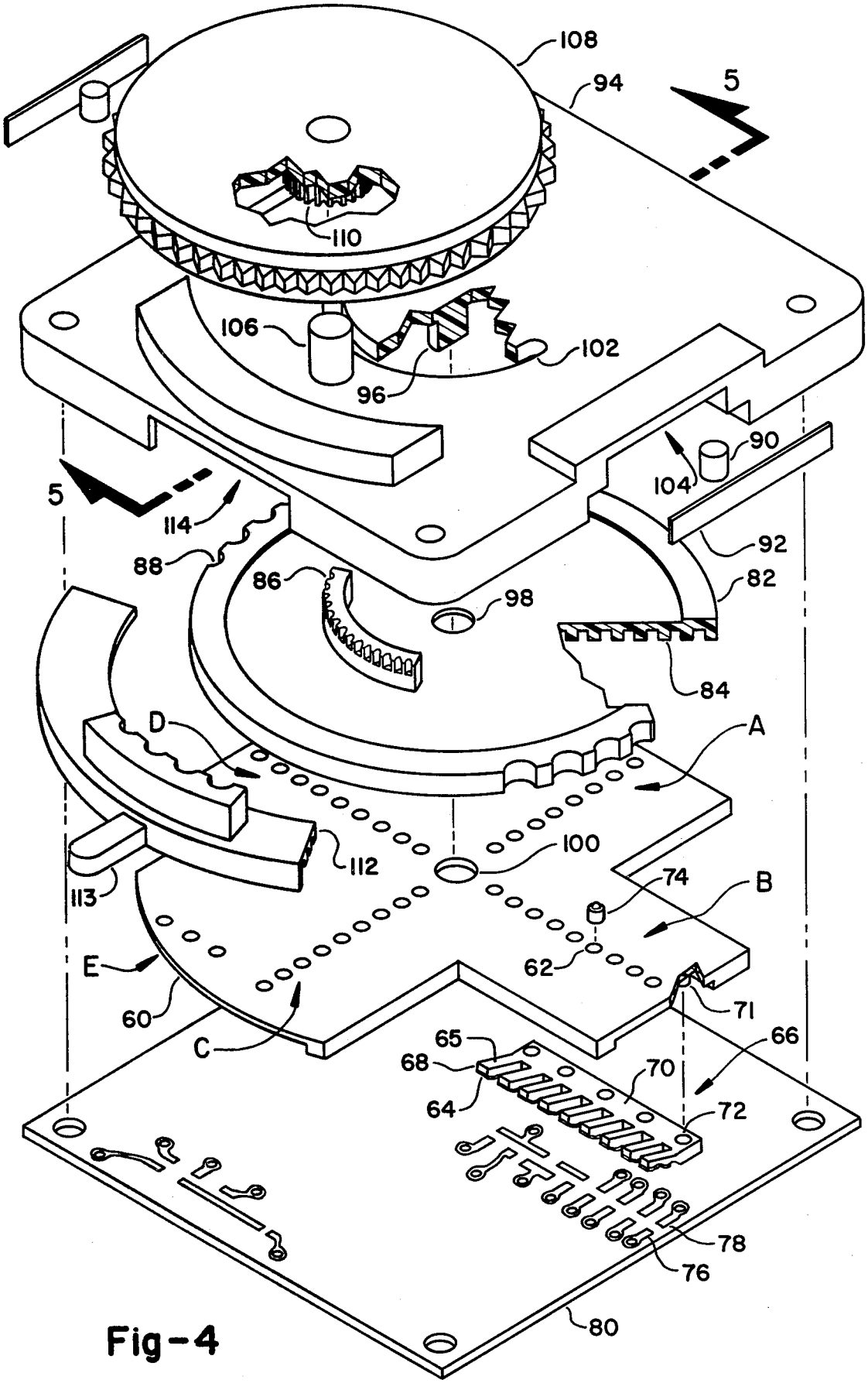
FIG. 4 is one embodiment of a switch apparatus made in accordance with the present invention.
Figure 5:
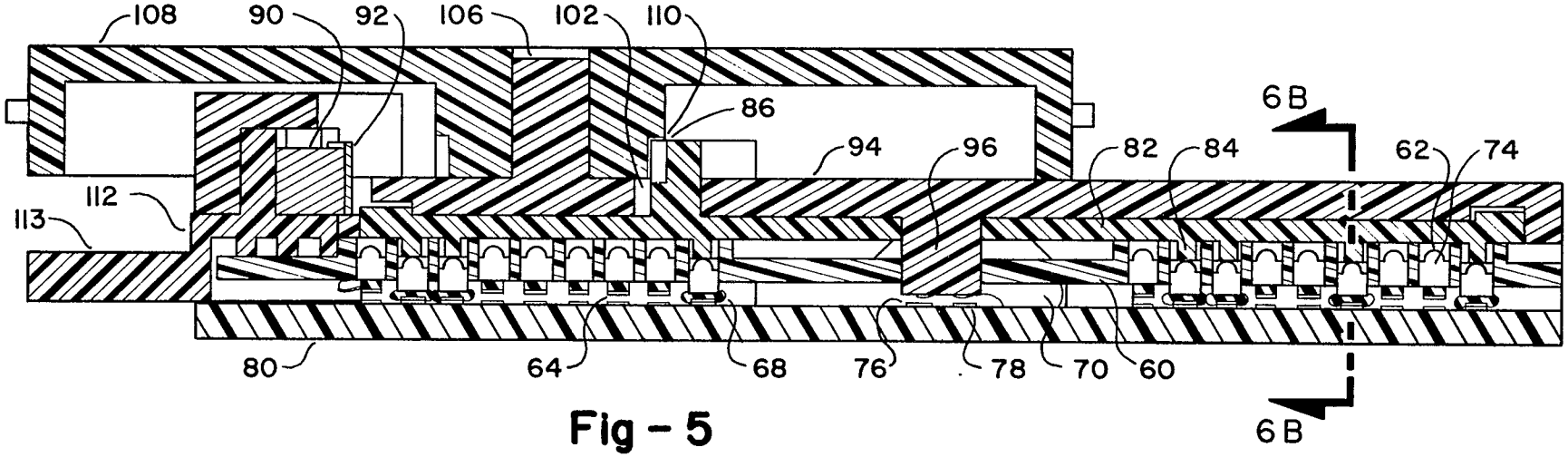
FIG. 5 is a sectional edge view of the switch apparatus shown in FIG. 4.
Figure 6B:
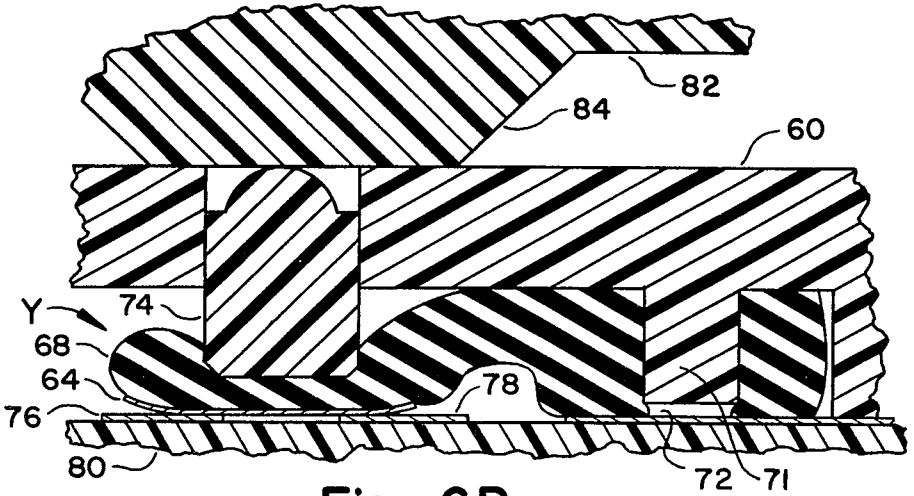
FIGS. 6A and 6B, is an additional view of the elastomeric material portion of the FIG. 4 embodiment to illustrate operation and action thereof.
Figure 6A:
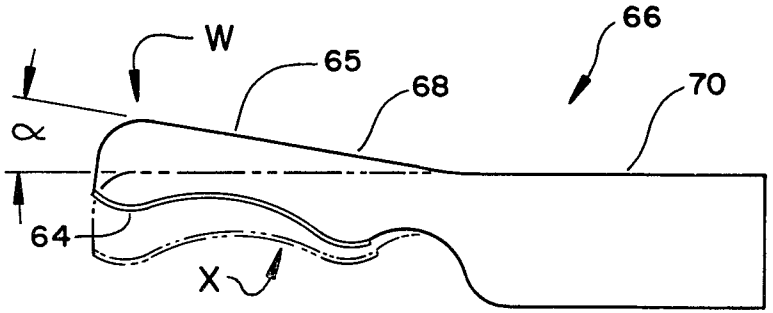

One preferred embodiment is shown in FIGS. 4 and 5 and defines a thumbwheel type minimum metal contact switch apparatus. It should be emphasized that this embodiment of the invention is directed only toward a switch apparatus, but the same principles apply to switched attenuators, etc. FIG. 4 is a perspective view of the apparatus with the components thereof in exploded view and portions thereof broken away for purposes of clarity, and FIG. 5 is an edge view of the apparatus taken along the line 5—5 of FIG. 4 with all of the components installed. All reference numerals corresponding to like components are the same in these two figures. As shown in these drawings, the apparatus includes four distinct switching sections; A, B, C, and D formed as portions of a girdle 60, preferably molded of a suitable material such as plastic. Disposed through the girdle 60 are a plurality of apertures defining, say, holes 62, there being any number of such apertures per section depending upon the desired switching or switching sequence. Removably carried on the bottom side of the girdle are the movable switch contacts secured to the elastomeric material as herebefore mentioned. In this embodiment a plurality of the movable contacts can be utilized depending upon the number of switching sections, and each distinct switching section will include one or more of the contacts which are secured to an elastomeric base. For clarity see FIG. 6 where only one such contact assembly is shown. The elastomeric material 66 is preferrably formed having a comb-like structure with fingers 68 extending outwardly and away from a body portion 70; the contacts 64 being secured to each finger thereof. The body portion 70 includes means such as, say, the holes 72 which removably receive guide and securing posts 71 which are an integral part of the girdle 60; in the mated state, the body portion 70 is carried by girdle 60 due to the resiliency of the elastomeric material which positively holds the guide and securing posts. The fingers 68 each align with a hole 62 so that a plurality of push pins 74 rests on the cam portion 65 when installed in the holes 62. Fingers 68 are formed, i.e., pre-loaded, to form a shallow acute angle, alpha, which is preferrably about 10° and which is best depicted in FIG. 6, position W. Once the body portion 70 has been resistively connected to the guide and securing posts 71 and the entire unit assembled together, which will be discussed later, the fingers 68 are forced to a position X, indicated by the phantom line in the Figure. Push pins 74 are used to activate the switch by forcing the finger associated therewith to move to the position Y and forcing the contacts 64 into contact with a set of fixed contact means 76, 78 which are formed by, say, conductive strips, or switch circuit pads, on a utilization means such as a circuit board 80. It is also possible for the utilization means to be a microcircuit such as an integrated circuit or hybrid circuit. When push pins 74 are not activated, the memory, i.e., restoring force, of the elastomeric material moves the contact member away from the fixed contact means 76, 78 back to the position X because of the preloading. Push pins 74 in the preferred embodiment are Nylatron GS Molydisulphiade filled for low frictional properties. An alternative to the above discussed girdle and push pins would be to form another girdle having cantilever formed cam followers, formed from a material having good flexing properties and low frictional properties such as an acetate resin, preferrably Fulton 404, 20% glass filled, for example, see FIG. 7 to be described elsewhere.

Push pins 74 can be activated by many known means, but the embodiment shown utilizes a logic wheel 82 having molded as a portion thereof a plurality of logic rings 84. Logic rings 84 are similar to the cam elements as described in U.S. Pat. No. 3,562,464 to C. H. Vollum et al and assigned to the assignee of the subject invention with the cam elements projecting from a rotatable flat actuator rather than a rotatable drum. As the coding of the rings depends upon the switching sequence desired and the distinct switching functions utilized, no further discussion thereof is deemed necessary. Logic wheel 82 also includes a logic wheel gear 86 and a plurality of detents 88 spaced around the periphery of the wheel. (Logic wheel gear 86 will be discussed elsewhere in the description.) Detents 88 are provided for receiving a detent roller 90 positively held therein by a spring means 92 to be discussed elsewhere. These detents clearly define a switch stop position and, with the detent rollers in each end position, prohibit further switch movement in that direction.

A housing means 94 is provided with an alignment means 96 defining an axle member which passes through aperture means 98 in the logic wheel 82 and 100 in the girdle 60, respectively. The housing includes opening 102, through which logic wheel gear 86 passes, and 104 into which is secured the already mentioned spring means 92 to positively secure detent roller 90. A second alignment means 106 is also provided and like alignment means 96, defines an axle member. A thumb wheel 108 having a thumb wheel gear 110 is removably received over the second mentioned axle. As can be discerned from the drawings, the thumb wheel gear 110 and logic wheel gear 86 mesh with one another for providing a means for causing the switch contact 64 to move between an open position away from the fixed contact means 76, 78 to a closed position causing switch contact 64 to move into contact with the fixed contact means 76, 78 or vice versa in accordance with the logic of logic rings 84 operating on push pins 74. When the switch is closed, the elastomeric material is deformed as best seen in FIGS. 5 and 6, and this insures that the contact areas make good electrical connection.

Although only two of the detent roller and spring means 92 are shown in the drawing of this embodiment, it is to be understood that a plurality thereof can be provided. In addition, the embodiment includes an additional logic segment 112 having an activation lever 113. This segment is disposed into an area 114 provided in the housing means 94 and is secured therein by further detent roller and spring means, not shown. The segment 112 includes logic rings form as an integral portion thereof and these rings cooperate with corresponding contact arrangements supported by the girdle 60; for example, in switching section E.

Thus, from the above description, it now is evident that as the logic rings are moved, push pins 74 are camed thereby and subsequently activate or causes the movable contacts to contact the fixed contacts 76, 78 in accordance with the logic provided. Also, it is clear from the description that the switch employs contacts which approach the ideal contact arrangement which enables the apparatus to be used in high frequency environments, and low or high impedance circuitry, which is an object of the present invention.

Figure 7A:
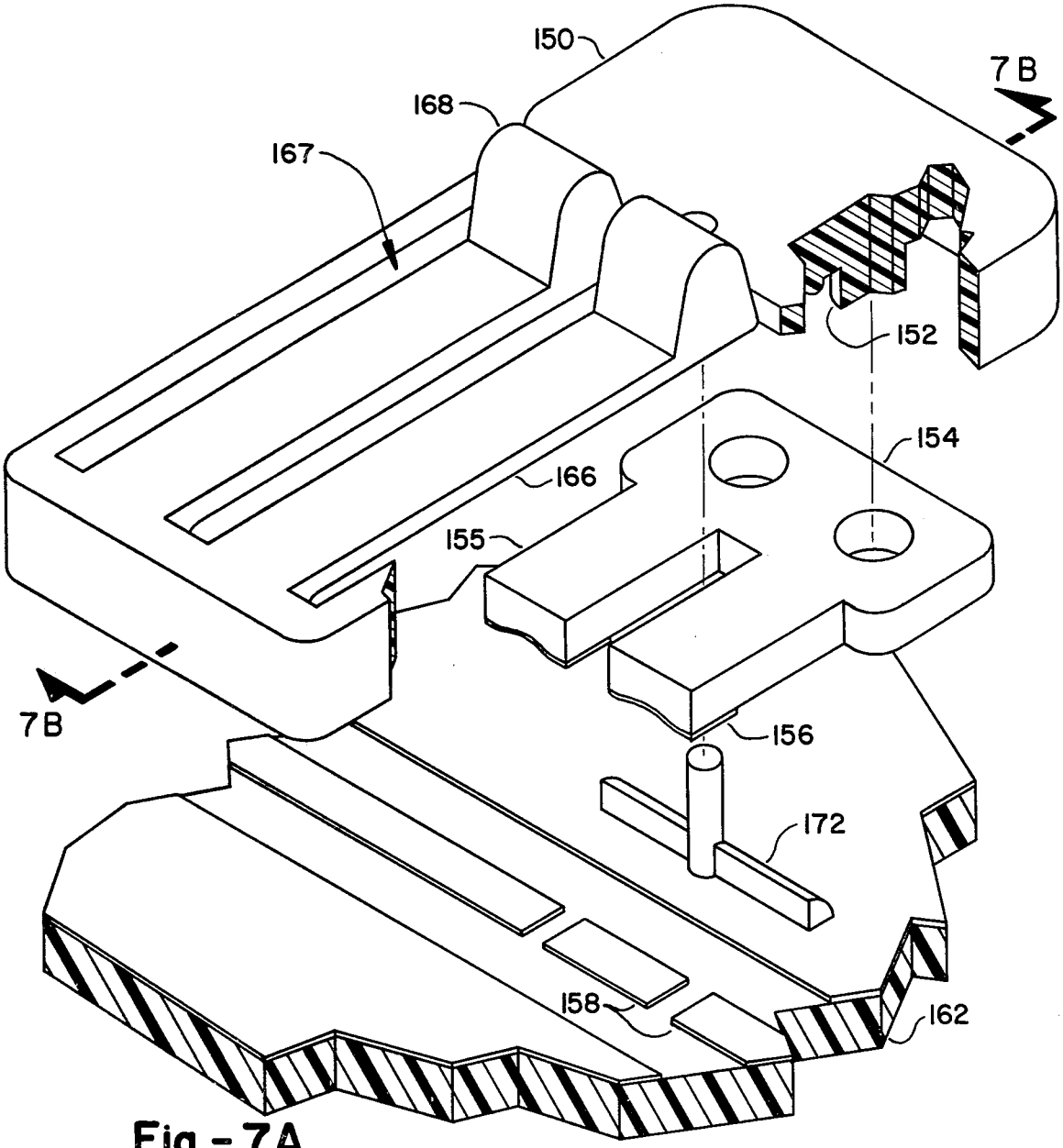
FIGS. 7A and 7B, is another switch apparatus according to the present invention.
Figure 7B:
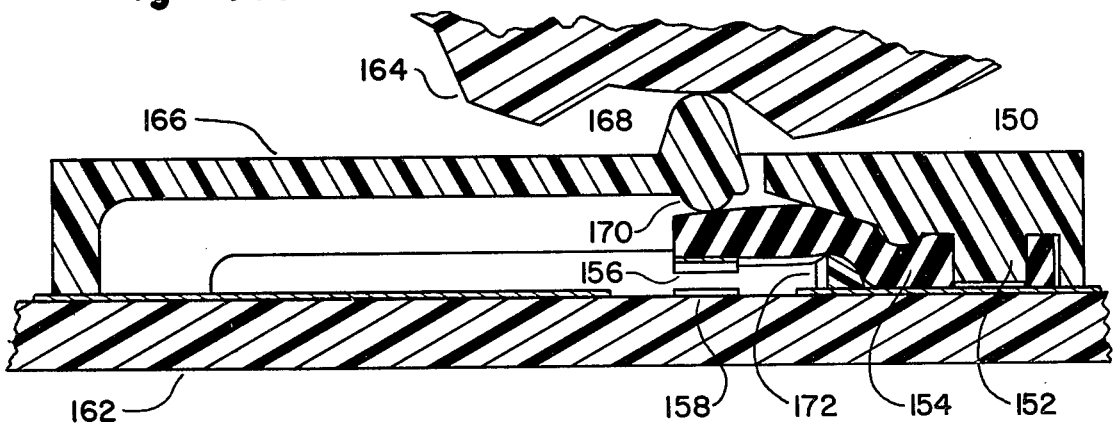

Attention is now directed to FIG. 7 wherein there is shown another switch apparatus according to the present invention. A girdle 150 formed from a suitable flexible material (such as Fulton 404) has cantilever fingers 166 which extend inwardly into a channel portion 167. These fingers include a cam follower portion 168 and a switch activator portion 170 which cooperates with a cam device 164 for moving a set of movable contacts 156 into engagement with a set of stationary contacts 158. The contacts 156 are, of course, provided on a surface of an elastomeric material in accordance with the present invention. The elastomeric material includes a body portion 154 and comb like fingers 155 extending outwardly therefrom. These fingers are pre-loaded by a cantilever support 172 which rests upon a surface of a support means such as a circuit board 162. The elastomeric material is held into position by a plurality of post means 152 provided as an integral portion of the girdle 150; this positions such that movable contacts 156 overlay fixed contacts 158 formed on the surface of the circuit board 162.

Figure 8A:
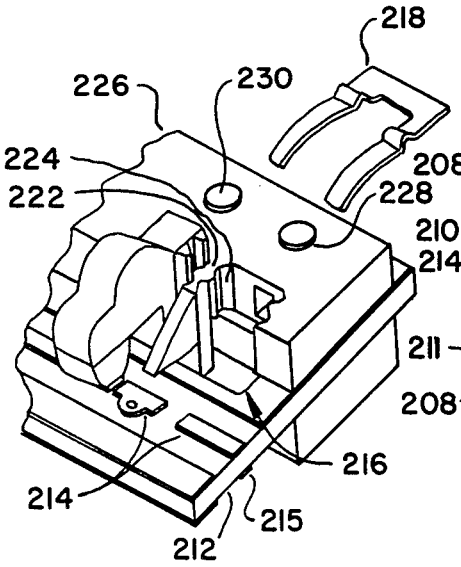
FIGS. 8A and 8B, is a "C" type dual sided switch apparatus according to the present invention.
Figure 8B:
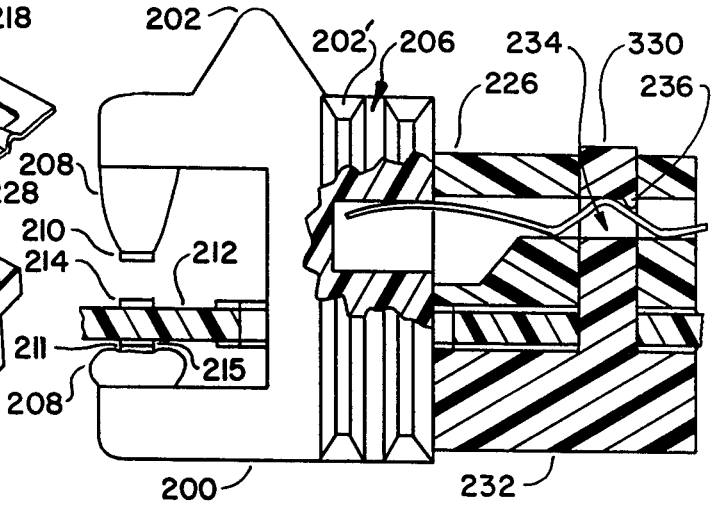
Figure 9A:
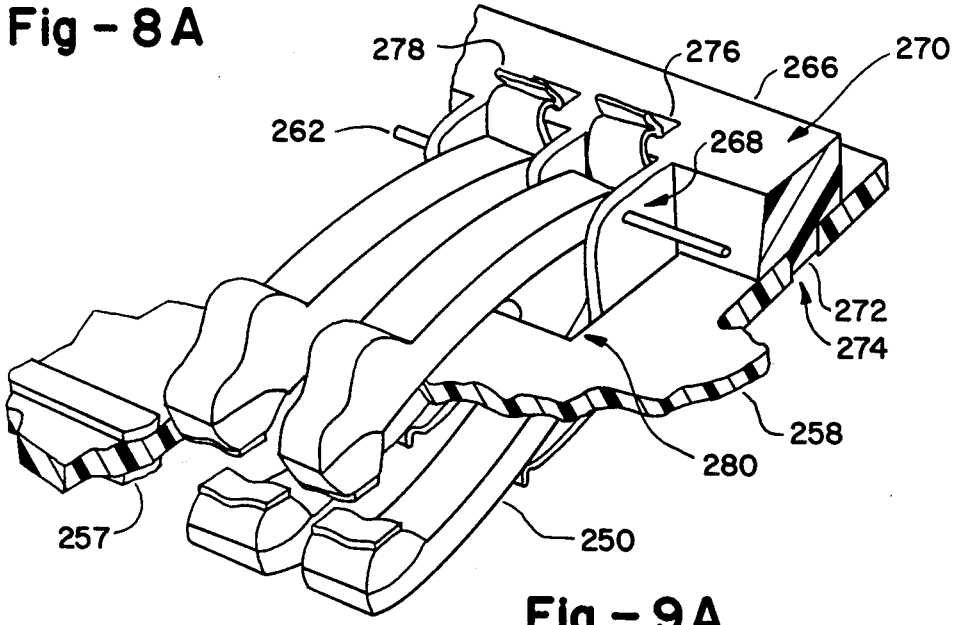
FIGS. 9A and 9B, is a pivot-type dual sided switch apparatus according to the present invention.
Figure 9B:
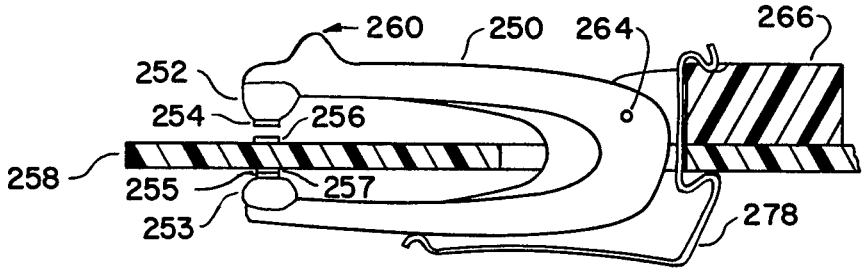
Figure 10A:
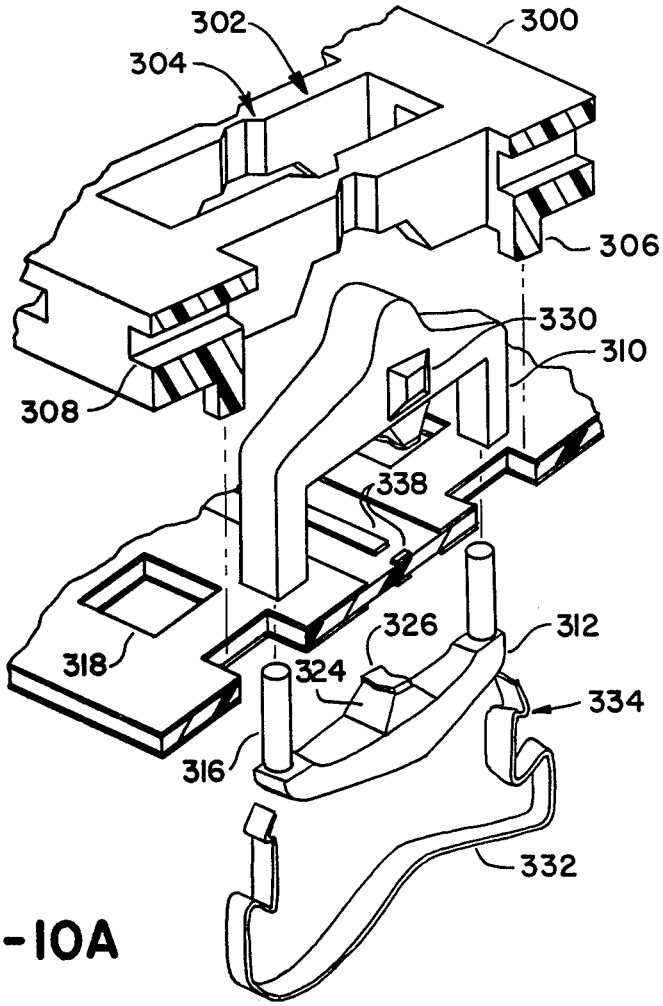
FIGS. 10A and 10B is a cage-type dual sided switch apparatus according to the present invention.
Figure 10B:
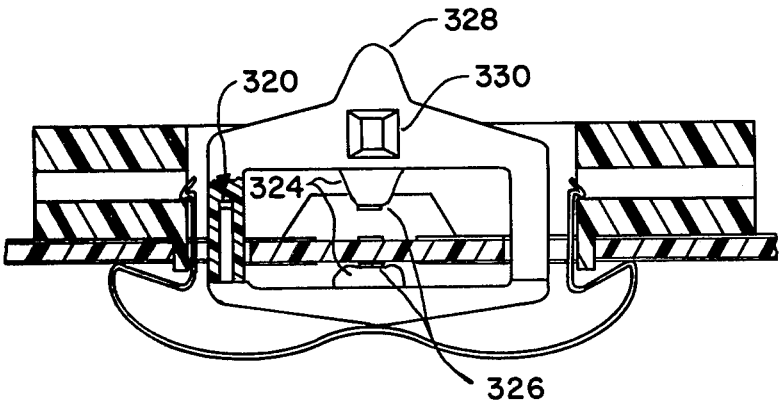

In FIGS. 8 through 10 a "C" slider, a pivot, a caged, and a combined "C" type switch apparatus in accordance with the present invention for providing dual sided switching apparatus are shown. With specific reference to FIG. 8, the "C" type slider switch includes a non-conductive one-piece "C" shaped member 200 having an activator portion 202 such as a cam follower and a ridge portion 202' defining slider guide means generally indicated at 206. Secured to member 200 is a pair of elastomeric material pads 208, each of which have metal contacts 210, 211 respectively secured thereto. The contacts 210 and 211 define movable contacts for mounting an opposite sides of an etched circuit board 212 and are ganged together by the member 200. Thus, downward pressure on the member 202, to move the contact 210 towards the circuit board 212, is transmitted through member 200 which moves contact 211 away from such circuit board. The contacts 210, 211 alternatively engage fixed contacts 214 and 215, respectively, provided as spaced metal strips coated on both sides of the circuit board 212. These metal strips can be, of course transmission lines. Also, it should be mentioned that the two pairs of fixed contacts on opposite sides of the circuit board may be displaced with the upper pair or vice versa.

Provided through circuit board 212 is an aperture 216 for removably receiving the member 200. This aperture also enables the member 200 to be moved so as to move the contacts 210, 211 into engagement with the fixed contacts. Member 200 is supported in the aperture by an assembly and return spring 218 received in an aperture 220 provided in the member 200 and is aligned in the aperture 216 by an additional ridge portion 222 defining further slider guides 224 coacting with the slider guides 206. Guides 224 are formed as a portion of an upper support girdle 226. This upper girdle also includes apertures 228 into which locating pins 330 are received. Locating pins 330 are formed as a portion of a lower support girdle 232 which includes a locking mechanism such as the aperture 234 having an obstruction portion 236 for locking the assembly and return spring 218 securely in place. As can be seen from FIG. 8, a plurality of "C" slide type switch devices can be mounted adjacent to one another. Such an embodiment would utilize a dual, triple, etc., assembly and return spring unit such as the unit 218.

FIG. 9 details a pivot type dual sided switch apparatus according to the present invention. A one-piece nonconductive pivoting member 250 having the shape approximating an elongated U has secured on each end thereof an elastomeric material 252, 253 which, in turn, have secured thereon metal contacts 254, 255. Contacts 254, 255 define movable switch contacts for connecting fixed contacts 256, 257 located on opposite sides of a circuit board or other utilization means 258. Fixed contacts 256, 257 could, as described previously, be interrupted metal strip line transmission lines coated or deposited on opposite sides of the circuit board. Thus, a downward movement (rotation) of member 250 due to pressure on a cam follower projection portion 260 of the member causes movable contact 254 to short fixed contact 256 and simultaneously, movable contact 255 moves away from the fixed contacts 257 to open such transmission line.

Pivot member 250 pivots about a contact pivot shaft 262 removably received through an aperture 264 provided in the pivot member and an additional aperture provided in a contact holding device 266. The holding device has a first portion 268 for carrying the pivot shaft 262 and a second portion 270 which includes locating pins 272 for disposal into locating holes 274 provided in the utilization means. Contact holding device 266 also includes a locating pocket 276 for a snap-in return and joining spring device 278. This spring is used for moving the pivot member 250 in a direction opposite to that caused by pressure on the cam follower portion 260. As can be discerned from this drawing, the pivot member 250 and spring device 278 passes through an aperture 280 provided in the circuit board. The size of the aperture 280 is determined by the number and spacing of pivot member utilized, and as shown in the drawing, can be more than one such member as desired.

Shown in FIG. 10 is a girdle 300 formed as a single unit of non-conductive material which includes an aperture 302, a plurality of guide tracks 304, a plurality of girdle locating post means 306 and a plurality of channels 308 defining spring locking pockets. The girdle defines the cage of a cage type switch apparatus in accordance with the present invention. An upper member 310 and a lower member 312 removably located, say, on opposite sides of a circuit board or other utilization means 314 and held together by a pair of post means 316 formed as an integral part of the lower member. The post means pass through apertures 318 in the circuit board for disposal in two sockets 320 provided in an end portion of the upper cage member 310. Both the upper and lower member includes an elastomeric material pad 324 secured or bonded thereto and has a metal contact 326 secured to the elastomeric pad. The upper member includes a cam follower projection portion 328 and a plurality of slider guide means 330. A snap-in return spring device 332, having locking means 334 formed therein for locking into channels 308, completes the unit.

As can be discerned from the drawing, cage 300 is precisely located on circuit board 314 by apertures 318 receiving post means 306. Upper member 310 slides in guide tracks 304 coacting with the slide guide means 330 in accordance with pressure on cam follower 328 or the restoring force of spring 332 to move the contacts 326 into or out of contact with the fixed contacts 338 provided on both sides of the circuit board. As the fixed contacts have already been discussed for the other embodiments, no further discussion thereof is deemed necessary. It should also be mentioned that the lower member 312 can be replaced or for that matter completely removed if it is not desired to have a dual sided switch. Of course, the snap-in spring 332 must be modified so that when pressure is not applied to the cam follower portion 328 a restoring force lifts the movable contacts from the fixed contact.

While there has been shown and described the preferred embodiment according to the present invention as well as other embodiments, it will be apparent to those skilled in the art that many changes and modifications may be made from the invention in its broader aspects. For example, a high frequency switch apparatus similar to that shown in FIG. 5 might be constructed having a pre-load lower contact activator so that it uses its own cantilever spring properties to hold the lower contacts closed. Therefore, the appended claims are intended to cover all such changes and modifications that fall within the true spirit and scope of the invention.

The invention is claimed in accordance with the following:

1. An electrical switch comprising a substantially planar dielectric support member, a first pair of longitudinally spaced, elongate metal strips disposed on one side of said support member with adjacent end portions of said strips forming a first pair of fixed electrical contacts, a second pair of longitudinally spaced, elongate metal strips disposed on the other side of said support member, with adjacent end portions of said second pair of strips forming a second pair of fixed electrical contacts, switch actuator means comprising a carrier for a pair of movable electrical contacts, said carrier including first and second portions of an elastomeric material, said movable contacts consisting of a third pair of elongate metal strips, each one bonded to a different portion of said elastomeric material, and means mounting said carrier on said support member, said mounting means being configured to position each movable contact opposite a different pair of fixed contacts, said actuator means further comprising means biasing one of said movable contacts into engagement with the fixed contacts disposed opposite it, actuation of said switch causing said one of the movable contacts to disengage, and the other to engage, the fixed contacts disposed opposite them in the switch.

2. The switch of claim 1, wherein said contact carrier is nonmetallic.

3. The switch of claim 1, wherein said contact carrier has a generally C-shaped configuration, each of said pair of movable contacts being bonded to the carrier adjacent a different free end thereof.

4. The switch of claim 1, wherein said contact carrier has a closed loop configuration, with said movable contacts being bonded to the loop at opposed locations on the inner circumference thereof.

* * * * *